US008870193B2

(12) United States Patent
Kowalski

(10) Patent No.: US 8,870,193 B2
(45) Date of Patent: Oct. 28, 2014

(54) DRY SURFACE CARVING SKI APPARATUS

(71) Applicant: Jacek Kowalski, Melbourne (AU)

(72) Inventor: Jacek Kowalski, Melbourne (AU)

( * ) Notice: Subject to any disclaimer, the term of this patent is extended or adjusted under 35 U.S.C. 154(b) by 23 days.

(21) Appl. No.: 13/656,769

(22) Filed: Oct. 22, 2012

(65) Prior Publication Data

US 2013/0106069 A1 May 2, 2013

(30) Foreign Application Priority Data

Oct. 28, 2011 (AU) ..... 2011904527

(51) Int. Cl.

| | |
|---|---|
| ***A63C 17/02*** | (2006.01) |
| ***A63C 17/06*** | (2006.01) |
| ***A63C 5/035*** | (2006.01) |
| ***A63C 17/16*** | (2006.01) |
| ***A63C 17/01*** | (2006.01) |
| ***A63C 17/04*** | (2006.01) |
| ***A63C 17/00*** | (2006.01) |
| *A63C 17/14* | (2006.01) |

(52) U.S. Cl.

CPC ..... *A63C 5/035* (2013.01); *A63C 17/1436* (2013.01); *A63C 17/064* (2013.01); *A63C 17/16* (2013.01); *A63C 17/016* (2013.01); *A63C 17/045* (2013.01); *A63C 17/013* (2013.01); *A63C 17/012* (2013.01); *A63C 17/0033* (2013.01)

USPC ..... 280/11.223; 280/11.25; 280/11.33; 280/11.27

(58) Field of Classification Search

CPC ..... A63C 17/02

USPC ..... 280/87.01, 87.042, 11.19, 11.223, 280/47.11, 11.208, 11.233, 11.25, 11.33, 280/11.27, 11.28

See application file for complete search history.

(56) References Cited

U.S. PATENT DOCUMENTS

| | | | | | |
|---|---|---|---|---|---|
| 1,625,421 | A | * | 4/1927 | Pearl | 280/47.11 |
| 2,162,128 | A | * | 6/1939 | Shoemaker | 280/11.19 |
| 2,719,724 | A | * | 10/1955 | Lundgren | 280/11.223 |
| 3,023,022 | A | | 11/1973 | Campos Bueno | |
| 3,771,811 | A | | 11/1973 | Campos | |
| 3,827,706 | A | | 8/1974 | Milliman | |
| 4,098,519 | A | * | 7/1978 | Reid, Jr. | 280/87.01 |
| 4,572,528 | A | | 2/1986 | McBride | |
| 4,991,861 | A | * | 2/1991 | Carn et al. | 280/87.042 |

(Continued)

FOREIGN PATENT DOCUMENTS

| | | |
|---|---|---|
| FR | 2891469 | 4/2007 |

*Primary Examiner* — Hau Phan

(74) *Attorney, Agent, or Firm* — Mark R. Malek; Zies Widerman & Malek

(57) ABSTRACT

The invention is a dry surface skiing apparatus including a leading self-steering swivel caster and trailing non self-steering swivel caster. It offers major safety improvements compared to the existing prior art. Its operation closer resembles modern carving ski and eliminates problems such as swivel caster flutter and undesirable drift effect with rotary turns. It also adds the ability to brake. Elimination of flutter is achieved by application of non self-steering trailing swivel caster which is cross connected to the leading self-steering swivel casters by a steering system. The ground friction of the wheel in the trailing swivel caster dampens the flutter. At the same time since the rear wheel turns in the opposite way to the front wheel, a carved turn is achieved in a similar manner to flexing a carving ski along its entire length. In order to facilitate braking wing like members are attached to the outer edge of each ski which allow transmitting friction of ski pole tips to the ski platform.

18 Claims, 2 Drawing Sheets

(56) References Cited

U.S. PATENT DOCUMENTS

| | | | | |
|---|---|---|---|---|
| 5,819,865 | A | 10/1998 | Cowley | |
| 6,270,096 | B1 * | 8/2001 | Cook | 280/87.042 |
| 7,195,259 | B2 | 3/2007 | Gang | |
| 7,784,833 | B2 | 8/2010 | Tsuchie | |
| 7,896,364 | B1 | 3/2011 | Ferreira | |
| 8,414,000 | B2 * | 4/2013 | Chen et al. | 280/87.042 |
| 2002/0195788 | A1 | 12/2002 | Tierney et al. | |

* cited by examiner

DRY SURFACE CARVING SKI APPARATUS

TECHNICAL FIELD

The present invention is in the area of sport and recreation equipment.

BACKGROUND ART

Modern carving or parabolic snow ski can be easily turned by applying leg pressure on the edges which is transmitted through the camber shape to the front and rear part of the concave side cut. Grass ski or in general dry surface ski is designed to simulate snow ski. The most commonly used grass ski design is based on the rolling tread disclosed in U.S. Pat. No. 4,572,528. This design although ensures smooth riding makes turning quite difficult. Tight turns, critical for speed control, are very hard to achieve making such device unsafe and unsuitable for most recreational skiers. This type of ski is mainly used for racing and summer training of competitive snow skiers.

The idea of applying swivel casters to devices that simulate ski was disclosed as early as 1974 in U.S. Pat. No. 3,827,706 and revisited a decade ago in US Patent 2002195788 which discloses a wheeled device referred to as street-ski. The street-ski design has been commercially implemented as a board device known as T-board. The T-board turns in response to shifting the weight of the rider on the board towards the edge of the board. The casters mounted on the underside of the T-board are equipped with springs that resist pivoting and return the wheels to the straight position.

U.S. Pat. No. 7,195,259 discloses in FIG. 5*a* a board design with a leading swivel caster and two trailing fixed casters which is capable of performing carved turns. A similar design is disclosed in a product known in Japan as Ro-ski which comprises a short ski-like platform, leading swivel caster and two offset parallel fixed casters mounted at the rear of the platform.

Another device aimed at simulation of snow ski is disclosed in U.S. Pat. No. 7,784,833. It uses four fixed wheels mounted near the centre of a narrow platform and two swivel casters with springs that resist pivoting at both ends. However, since the casters are mounted in the same direction this device will not simulate carving.

SUMMARY OF INVENTION

The objective of the invention presented herein is to provide wheeled skiing apparatus which does not suffer from safety problems such as speed wobbles caused by swivel caster flutter and simulates kinematics of carving ski. Further objective of the current invention is to improve safety of skiing on wheeled devices by providing a simple braking mechanism.

In accordance with the present invention there is provided a dry surface ski apparatus that comprises a leading self-steering swivel caster, a trailing non self-steering swivel caster both mounted to the underside of an elongated platform supporting the skier, a steering system connecting the leading caster fork to the trailing caster fork which transmits the steering movement of the leading swivel caster to the steering movement in the opposite direction of the trailing swivel caster. The steering movement of the self-steering leading swivel caster is induced by rolling skier's knees in the required direction of turn. The turn is then tightened by the steering system which steers the trailing caster wheel in the opposite direction thus making it similar to the trajectory of a flexed carving ski.

If flutter of the leading self-steering caster was to occur the oscillation would be transmitted by the steering system to the trailing non self-steering swivel caster. The ground friction forces acting on the trailing caster would then dampen the flutter.

In order to facilitate braking a wing like member is attached to the outer edge of each skier supporting elongated platform in front of the ski binding. When the skier plants ski poles in front of these wing like members the ground friction force of the ski pole tips is transmitted to the skis which allows slowing down and stopping.

Technical Problem

Wheeled devices simulating modern carving skis by means of utilising self-steering swivel casters are prone to speed wobbles due to caster flutter.

In particular if the street-ski design disclosed in US Patent 2002195788 was to be applied to skis with skier's feet immobilised in boots bound to the platform, edge pressure could only be applied by rolling the knees sideways. Such edge pressure force would not be very strong and thus require soft springs especially in the leading swivel casters to allow tight turns. However, soft springs would make the swivel casters prone to flutter and result in potentially dangerous speed wobbles.

Another problem with the design of street-ski is that many skiers especially at the beginner to intermediate level have natural tendency to perform rotary turns by twisting their feet. This would result in both leading and trailing swivel casters turning in the same rather than the opposite directions causing drift movement instead of a carved turn.

The design disclosed in FIG. 5*a* of U.S. Pat. No. 7,195,259 does not suffer from the drift problem during rotary turns but is prone to flutter of the leading swivel caster. Moreover, this design in which the trailing caster is fixed only simulates flexing of the front part of a modern carving ski while such ski flexes along its entire length.

A fundamental safety problem of wheeled devices simulating skis is lack of ability to brake.

Solution to Problem

The problem of flutter is solved by connecting the leading self-steering swivel caster to a non self-steering trailing swivel caster by a steering system in such a way that when the leading caster is steered in one direction by the skier the trailing caster is automatically steered in the opposite way. Ground friction reactive forces acting on the trailing caster resist steering and are transmitted through the steering system to the leading caster thus dampening flutter if it was to occur. At the same time the leading and trailing swivel casters which turn in the opposite directions in a synchronised manner prevent drift movement and closely simulate flexing of carving ski along its entire length.

In order to facilitate braking a wing like member is attached to the outer edge of each skier supporting elongated platform in front of the ski binding. When the skier plants ski poles in front of these wing like members the ground friction forces acting on the ski pole tips are transmitted to the skis which allows slowing down and stopping.

Advantageous Effect of Invention

The invention offers significant improvement in safety and kinematics of wheeled devices simulating modern carving ski. It eliminates speed wobbles caused by swivel caster flutter and enables better speed control and braking.

DESCRIPTION OF EMBODIMENTS

Figure 1:
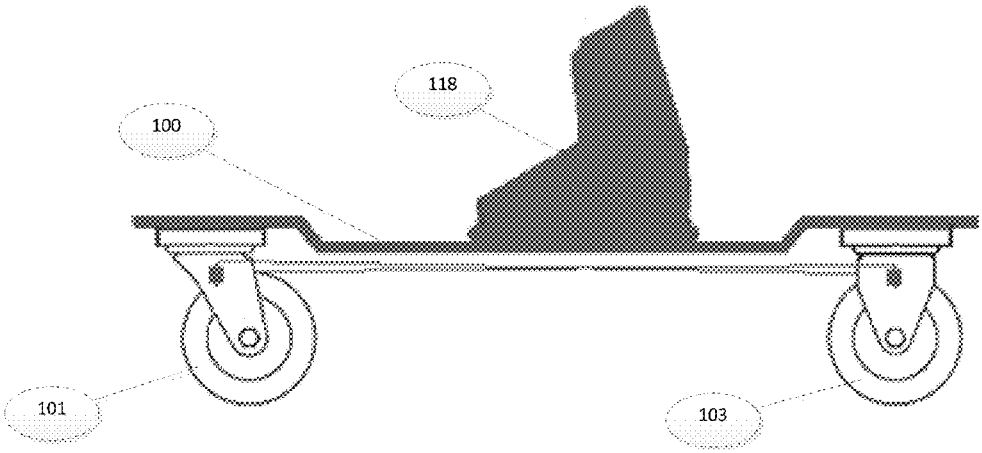
FIG. 1 is the side view of the first embodiment of the invention.

As used herein a swivel caster whose swivel radius is greater than the radius of the caster wheel is referred to as a self-steering swivel caster. Such swivel caster can automatically align to the direction of travel. A swivel caster whose swivel radius is equal to the radius of the caster wheel is herein referred to as a non self-steering swivel caster. Such swivel caster cannot automatically align to the direction of travel.

The convention adopted in this document for describing similar elements appearing in different figures is such that the callouts to such elements have different leading digits inherited from the figure number but identical two-digit trailing parts. In particular callouts 100, 200, 300 and 400 refer to an elongated platform, callouts 101, 201, 301 and 401 refer to a leading self-steering swivel caster, callouts 103, 203, 303 and 403 refer to a trailing non self-steering swivel caster, callouts 207, 307 and 407 refer to the swivel axis of the leading self-steering swivel caster, callouts 210, 310 and 410 refer to the swivel axis of the trailing non self-steering swivel caster, callouts 209, 309 and 409 refer to the axle of the leading self-steering swivel caster, callouts 208, 308 and 408 refer to the axle of the trailing non self-steering swivel caster and finally callouts 220, 320 and 420 refer to a wing-like member.

Figure 2:
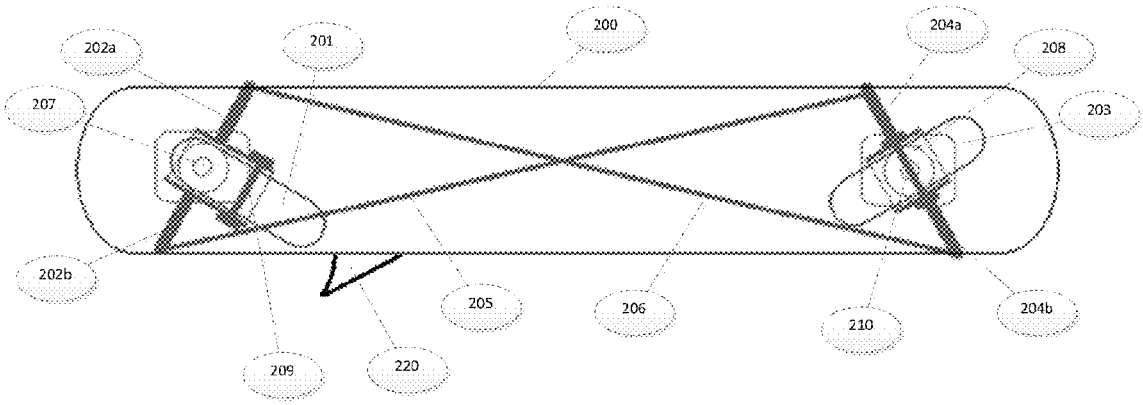
FIG. 2 is the top view of the first embodiment of the invention.

Referring to FIG. 1 and FIG. 2, the first preferred embodiment of a dry surface ski apparatus comprises a self-steering leading swivel caster 101, a trailing non self-steering swivel caster 103 (203), a skier supporting elongated platform 100 (200), a steering system with steering arms 202*a*, 202*b*, 204*a*, 204*b* and tie rods 205 and 206. The swivel axis 207 of said leading self-steering swivel caster 101 is in a forward position with respect to the caster wheel axle 209. The swivel axis 210 of said non self-steering swivel caster is positioned in the same plane as the caster wheel axle 208.

Said steering arms 202*a* and 202*b* are rigidly attached to respectively the right-hand and left-hand sides of fork of the leading caster 201. Similarly, there are steering arms 204*a* and 204*b* rigidly attached to respectively the right-hand and left-hand side of the fork of trailing caster 203. The left steering arm 202*b* of the leading caster is connected to the right steering arm 204*a* of the trailing caster by a tie rod 205. The right steering arm 202*a* of the leading caster is connected to the left steering arm 204*b* of the trailing caster by a tie rod 206. Said tie rods 205 and 206 are pivotably attached at the ends to said steering arms 202*a*, 202*b* and 204*a* and 204*b* and transmit steering movement of the leading caster to the opposite steering movement of the trailing caster i.e. if the leading caster turns left the trailing caster turns right and if the leading caster turns right the trailing caster turns left.

It is obvious that if tie rod 205 (alternatively 206) is sufficiently rigid the steering system only comprising steering arm 202*b* (alternatively 202*a*), steering arm 204*a* (respectively 204*b*) and tie rod 206 (respectively 205) will achieve the same functionality as the steering system comprising all these members. The advantage of the steering system having all the members above is that none of tie rods 205 and 206 has to be rigid, for instance they both can be cables.

If flutter of said swivel caster 101 occurs during travel the oscillations are transmitted to trailing swivel caster 103 and dampened by resistive ground friction of the wheel of said caster 103.

Preferably the forks of said leading and trailing casters are made from metal and the wheel rims are made from metal or plastic. Preferably the wheels have rubber tyres. Preferably said skier supporting elongated platform is made from a light composite material or light metal. Preferably the members of said steering system are made from metal.

There is a ski boot 118 attached to the supporting elongated platform 100 (200) between the leading and trailing casters by means of a ski binding. Preferably the supporting elongated platform 100 is shaped in such a way that its middle section is lowered towards the ground.

A wing like member 220 is attached to the outer edge of each skier supporting elongated platform in front of the ski binding. When a ski pole is planted in front of said member 220 the ground friction of the ski pole tip is transmitted by said member 220 to the elongated platform and causes the skier to slow down and stop.

Figure 3:
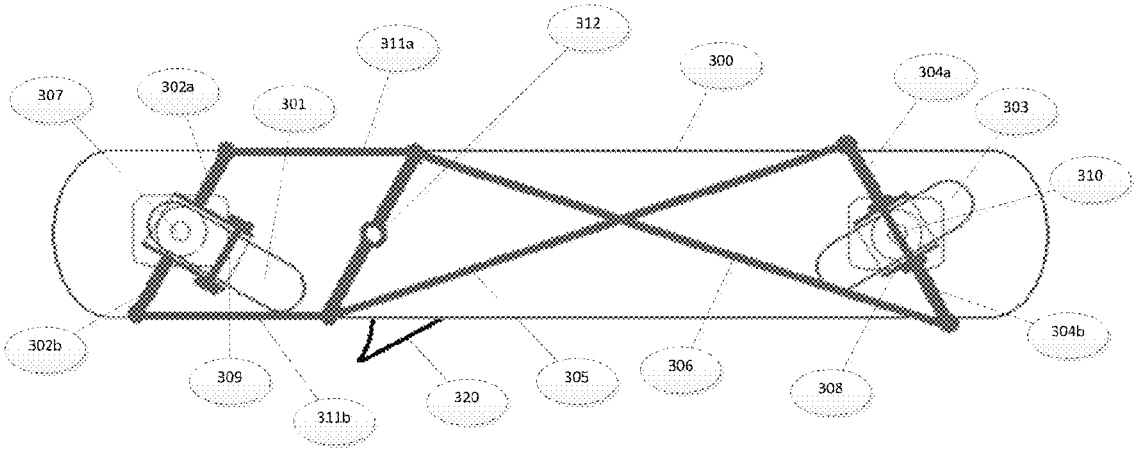
FIG. 3 is the top view of the second embodiment of the invention.

The second preferred embodiment presented in FIG. 3 is similar to the first preferred embodiment except for the steering system between the leading self-steering swivel caster and trailing non self-steering swivel caster. Said steering system in the second preferred embodiment comprises tie rods 311*a*, 311*b* pivotably attached to steering arms 302*a*, 302*b* and pivotably attached to member 312 which is a first class lever pivotably attached at its centre to the underside of the elongated platform supporting the skier. Tie rods 305 and 306 are also pivotably attached to said member 312 and connected in a cross over way to the steering arms 304*a* and 304*b*. Said tie rods are preferably stretch resistant but not necessarily very rigid. This steering system allows for more space for wheel sideways movement of the caster wheels.

Figure 4:
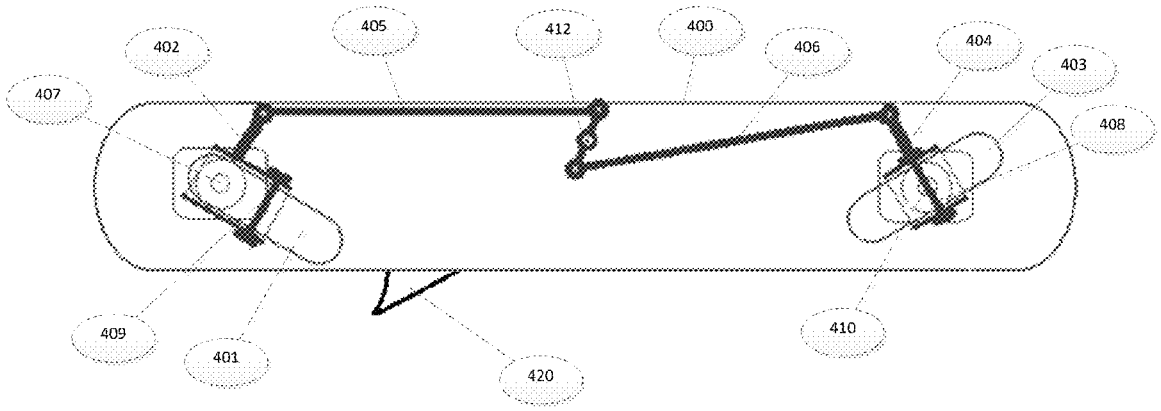
FIG. 4 is the top view of the third embodiment of the invention.

The third preferred embodiment presented in FIG. 4 is similar to the first preferred embodiment except for the steering system between the leading self-steering swivel caster and trailing non self-steering swivel caster. Said steering system in the third preferred embodiment comprises steering arm 402 rigidly attached to the right-hand side of the fork of the leading self-steering caster, rigid connecting member 405 pivotably attached to said steering arm 402 at one end and pivotably attached to member 412. Member 412 is a first class lever pivotably attached at its centre to the elongated platform and pivotably attached to rigid connecting member 406. Said rigid connecting member 406 is pivotably attached to steering arm 404 which is rigidly attached to the right-hand side of the fork of the trailing non self-steering swivel caster. Said rigid connecting members 405 and 406 are rigid and preferably made from metal tubes to reduce their weight. It is obvious that the steering arms 402 and 404 can either be attached to the right-hand side or the left-hand side of the respective forks and in a pair of skis the steering arms of the left ski should preferably be on the left-hand side and the steering arms of the right ski should preferably be on the right-hand side.

It will be appreciated that applications of the present invention are not limited to skiing and the connected leading self-steering swivel caster and rear non self-steering swivel caster can be applied to other devices such as in-line skates and skateboards.

Although the present invention has been illustrated with reference to certain preferred embodiments, it will be obvious to those skilled in the art that it is not limited to the specifics set forth therein and modifications and variations especially with respect to the steering mechanism will be possible within the spirit and scope of the present invention. All such variations and modifications are intended to be covered by the present invention.

Industrial Applicability

The application of the present invention is mainly as an off-season training device which can be used by skiers to improve their skiing technique and fitness. Since the device is primarily turned by rolling skier's knees in the direction of turn and sliding is impossible, the device is particularly suitable for learning the modern technique of skiing.

Testing of the proof of concept device built according to the first preferred embodiment confirmed its expected behaviour and gained favourable reviews by skiing instructors and coaches including former Olympic skiers.

References

U.S. Pat. No. 4,572,528
U.S. Pat. No. 3,827,706
US 2002195788
U.S. Pat. No. 7,195,259
U.S. Pat. No. 7,784,833
US 2002195788

The invention claimed is:

1. A skiing apparatus comprising:

an elongated platform having a leading end and a trailing end opposite the leading end;

a leading self-steering swivel caster mounted to and extending downwardly from a bottom portion of the leading end of the elongated platform;

a trailing non self-steering swivel caster mounted to and extending downwardly from a bottom portion of the trailing end of the elongated platform; and a steering system comprising:

at least one steering arm connected to and extending laterally outwardly from the leading self-steering swivel caster defined as at least one leading self-steering swivel caster steering arm, at least one steering arm connected to and extending laterally outwardly from the trailing non self-steering swivel caster defined as at least one trailing non self-steering swivel caster steering arm, and at least one tie rod connected to and extending between the at least one leading self-steering swivel caster steering arm and the at least one trailing non self-steering swivel caster steering arm;

wherein the at least one tie rod causes the trailing non self-steering swivel caster to swivel responsive to swiveling of the leading self-steering swivel caster.

2. The skiing apparatus of claim 1 wherein the at least one leading self-steering swivel caster steering arm is aligned to be substantially perpendicular with a swivel axis of the leading self-steering swivel caster and offset from an axle of the leading self-steering swivel caster; and wherein the at least one trailing non self-steering swivel caster steering arm is aligned to be substantially perpendicular with a swivel axis of the trailing non self-steering swivel caster and aligned with an axle of the trailing non self-steering swivel caster.

3. The skiing apparatus of claim 1 wherein the at least one leading self-steering swivel caster steering arm is connected to and extends between the leading self-steering swivel caster and a first end of the at least one tie rod; and wherein the at least one trailing non self-steering swivel caster steering arm is connected to and extends between the trailing non self-steering swivel caster and a second end of the at least one tie rod, the second end of the at least tie rod being opposite the first end of the at least one tie rod.

4. The skiing apparatus of claim 1 wherein the at least one leading self-steering swivel caster steering arm comprises a first steering arm connected to a first side of the leading self-steering swivel caster and a second steering arm connected to a second side of the leading self-steering swivel caster; wherein the at least one trailing non self-steering swivel caster steering comprises a first steering arm connected to a first side of the trailing non self-steering swivel caster and a second steering arm connected to a second side of the trailing non self-steering swivel caster; and wherein the first steering arm of both the leading self-steering swivel caster steering arm and the trailing non self-steering swivel caster steering arm is positioned opposite the second steering arm of both the leading self-steering swivel caster steering arm and the trailing non self-steering swivel caster steering arm.

5. The skiing apparatus of claim 4 wherein the at least one tie rod comprises a first tie rod connected to and extending between the first steering arm connected to the first side of the leading self-steering swivel caster and the second steering arm connected to the second side of the trailing non self-steering swivel caster and a second tie rod connected to and extending between the second steering arm connected to the second side of the leading self-steering swivel caster and the first steering arm connected to the first side of the trailing non self-steering swivel caster.

6. The skiing apparatus of claim 1 wherein the elongated platform comprises a ski binding located between the leading self-steering swivel caster and the trailing non self-steering swivel caster and mounted to an upper portion of the elongated platform, the ski binding configured to hold a ski boot.

7. The skiing apparatus of claim 1 further comprising a wing like member connected to an outer edge of the elongated platform.

8. The skiing apparatus of claim 1 wherein the steering system further comprises:

a first steering arm connected to and extending laterally outwardly from a first side of the leading self-steering swivel caster;

a second steering arm connected to and extending laterally outwardly from a second side of the leading self-steering swivel caster;

a first steering arm connected to and extending laterally outwardly from a first side of the trailing non self-steering swivel caster;

a second steering arm connected to and extending laterally outwardly from a second side of the trailing non self-steering swivel caster;

a member offset from the leading self-steering swivel caster and positioned substantially parallel to the first steering arm connected to the first side of the leading self-steering swivel caster and the second steering arm connected to the second side of the leading self-steering swivel caster, the member comprising a respective first end and a second end;

a first tie rod connected to and extending between an end of the first steering arm connected to the first side of the leading self-steering swivel caster and the first end of the member;

a second tie rod connected to and extending between an end of the second steering arm connected to the second side of leading self-steering swivel caster and the second end of the member, the second end of the member positioned opposite the first end of the member;

a third tie rod connected to and extending between an end of the first steering arm connected to the first side of the trailing non self-steering swivel caster and the second end of the member; and a fourth tie rod connected to and extending between an end of the second steering arm connected to the second side of the trailing non self-steering swivel caster and the first end of the member.

9. The skiing apparatus of claim 1 wherein the at least one leading self-steering swivel caster steering arm is one leading self-steering swivel caster steering arm extending laterally outwardly from the leading self-steering swivel caster; wherein the at least one trailing non self-steering swivel caster steering arm is one trailing non self-steering swivel caster steering arm extending laterally outwardly from the trailing non self-steering swivel caster; and wherein the steering system further comprises:

a member located between the leading self-steering swivel caster and the trailing non self-steering swivel caster;

a first rigid connecting member connected to and extending between the leading self-steering swivel caster steering arm and the member; and a second rigid connecting member connected to and extending between the trailing non self-steering swivel caster steering arm and the member.

10. A skiing apparatus comprising:

an elongated platform having a leading end and a trailing end opposite the leading end;

a leading self-steering swivel caster mounted to and extending downwardly from a bottom portion of the leading end of the elongated platform;

a trailing non self-steering swivel caster mounted to and extending downwardly from a bottom portion of the trailing end of the elongated platform; and a steering system comprising:

a leading self-steering swivel caster steering arm comprising a first steering arm connected to and extending laterally outwardly from a first side of the leading self-steering swivel caster and a second steering arm connected to and extending laterally outwardly from a second side of the leading self-steering swivel caster, wherein the first steering arm is positioned opposite the second steering arm, a trailing non self-steering swivel caster steering arm comprising a first steering arm connected and extending laterally outwardly from to a first side of the trailing non self-steering swivel caster and a second steering arm connected to and extending laterally outwardly from a second side of the trailing non self-steering swivel caster, wherein the first steering arm is positioned opposite the second steering arm, a first tie rod connected to and extending between the first steering arm connected to and extending laterally outwardly from the first side of the leading self-steering swivel caster and the second steering arm connected to the second side of the trailing non self-steering swivel caster, and a second tie rod connected to and extending between the second steering arm connected to and extending laterally outwardly from the second side of the leading self-steering swivel caster and the first steering arm connected to and extending laterally outwardly from the first side of the trailing non self-steering swivel caster, wherein the leading self-steering swivel caster steering arm is aligned to be substantially perpendicular with a swivel axis of the leading self-steering swivel caster and offset from an axle of the leading self-steering swivel caster, wherein the trailing non self-steering swivel caster steering arm is aligned to be substantially perpendicular with a swivel axis of the trailing non self-steering swivel caster and aligned with an axle of the trailing non self-steering swivel caster;

wherein the first and second tie rods cause the trailing non self-steering swivel caster to swivel responsive to swiveling of the leading self-steering swivel caster.

11. The skiing apparatus of claim 10 wherein the elongated platform comprises a ski binding located between the leading self-steering swivel caster and the trailing non self-steering swivel caster and mounted to an upper portion of the elongated platform, the ski binding configured to hold a ski boot.

12. The skiing apparatus of claim 10 further comprising a wing like member connected to an outer edge of the elongated platform.

13. A skiing apparatus comprising:

an elongated platform having a leading end and a trailing end opposite the leading end;

a leading self-steering swivel caster mounted to and extending downwardly from a bottom portion of the leading end of the elongated platform;

a trailing non self-steering swivel caster mounted to and extending downwardly from a bottom portion of the trailing end of the elongated platform; and a steering system comprising:

a leading self-steering swivel caster steering arm comprising a first steering arm connected to a first side of the leading self-steering swivel caster and a second steering arm connected to a second side of the leading self-steering swivel caster, wherein the first steering arm is positioned opposite the second steering arm, a trailing non self-steering swivel caster steering arm comprising a first steering arm connected to a first side of the trailing non self-steering swivel caster and a second steering arm connected to a second side of the trailing non self-steering swivel caster, wherein the first steering arm is positioned opposite the second steering arm, a member offset from the leading self-steering swivel caster and positioned substantially parallel to the first steering arm connected to the first side of the leading self-steering swivel caster and the second steering arm connected to the second side of the leading self-steering swivel caster, the member comprising a respective first end and a second end positioned opposite the first end, a first tie rod connected to and extending between an end of the first steering arm connected to the first side of the leading self-steering swivel caster and the first end of the member, a second tie rod connected to and extending between an end of the second steering arm connected to the second side of leading self-steering swivel caster and the second end of the member, a third tie rod connected to and extending between an end of the first steering arm connected to the first side of the trailing non self-steering swivel caster and the second end of the member, a fourth tie rod connected to and extending between an end of the second steering arm connected to the second side of the trailing non self-steering swivel caster and the first end of the member; and a wing like member connected to an outer edge of the elongated platform;

wherein the first, second, third and fourth tie rods cause the trailing non self-steering swivel caster to swivel responsive to swiveling of the leading self-steering swivel caster.

14. The skiing apparatus of claim 13 wherein the leading self-steering swivel caster steering arm is aligned to be substantially perpendicular with a swivel axis of the leading self-steering swivel caster and offset from an axle of the leading self-steering swivel caster; and wherein the trailing non self-steering swivel caster steering arm is aligned to be substantially perpendicular with a swivel axis of the trailing non self-steering swivel caster and aligned with an axle of the trailing non self-steering swivel caster.

15. The skiing apparatus of claim 13 wherein the elongated platform comprises a ski binding located between the leading self-steering swivel caster and the trailing non self-steering swivel caster and mounted to an upper portion of the elongated platform, the ski binding configured to hold a ski boot.

16. A skiing apparatus comprising:

an elongated platform having a leading end and a trailing end opposite the leading end;

a leading self-steering swivel caster mounted to and extending downwardly from a bottom portion of the leading end of the elongated platform;

a trailing non self-steering swivel caster mounted to and extending downwardly from a bottom portion of the trailing end of the elongated platform;

a ski binding located between the leading self-steering swivel caster and the trailing non self-steering swivel caster and mounted to an upper portion of the elongated platform, the ski binding configured to hold a ski boot; and a steering system comprising:

a leading self-steering swivel caster steering arm connected to and extending laterally outwardly from the leading self-steering swivel caster, a trailing non self-steering swivel caster steering arm connected to and extending laterally outwardly from the trailing non self-steering swivel caster, a member located between the leading self-steering swivel caster and the trailing non self-steering swivel caster, a first rigid connecting member connected to and extending between the leading self-steering swivel caster steering arm and the member, and a second rigid connecting member connected to and extending between the trailing non self-steering swivel caster steering arm and the member;

wherein the first and second rigid connecting members cause the trailing non self-steering swivel caster to swivel responsive to swiveling of the leading self-steering swivel caster.

17. The skiing apparatus of claim 16 wherein the leading self-steering swivel caster steering arm is aligned to be substantially perpendicular with a swivel axis of the leading self-steering swivel caster and offset from an axle of the leading self-steering swivel caster; and wherein the trailing non self-steering swivel caster steering arm is aligned to be substantially perpendicular with a swivel axis of the trailing non self-steering swivel caster and aligned with an axle of the trailing non self-steering swivel caster.

18. The skiing apparatus of claim 16 further comprising a wing like member connected to an outer edge of the elongated platform.

* * * * *